United States Patent [19]

Shannon

[11] 4,138,188

[45] Feb. 6, 1979

[54] COAXIAL CABLE PLUG WITH CENTER CONDUCTOR AS CENTER CONTACT

[75] Inventor: Suel G. Shannon, Harrisburg, Pa.

[73] Assignee: AMP Incorporated, Harrisburg, Pa.

[21] Appl. No.: 862,712

[22] Filed: Dec. 21, 1977

[51] Int. Cl.[2] ..... H01R 17/18
[52] U.S. Cl. ..... 339/177 E; 339/278 R
[58] Field of Search ..... 339/177 R, 177 E, 278 R

[56] References Cited

FOREIGN PATENT DOCUMENTS 1,337,253 11/1973 United Kingdom ..... 339/177 R

*Primary Examiner*—Gerald A. Dost

[57] ABSTRACT

An end plug for a coaxial cable in which the center conductor contact comprises an extension of the dielectric spacer of the plug with the center conductor of the cable being positioned around the spacer extension in grooves formed therein. The depth of the grooves is less than the center conductor diameter so that the center conductor extends out the grooves and will make electrical contact with a mating connector.

14 Claims, 10 Drawing Figures

COAXIAL CABLE PLUG WITH CENTER CONDUCTOR AS CENTER CONTACT

BACKGROUND OF THE INVENTION

This invention relates generally to connector means for terminating the end of a coaxial cable and more particularly to an improvement in that the center contact consists of the center conductor supported on an extension of the insulative spacer of the connector rather than employing conventional center contact pins or unsupported center conductors of the coaxial cable.

One of the most common ways of terminating the center conductors of a coaxial cable is by means of a tubular metal element which is crimped or soldered around the stripped center conductor of the cable. The tubular metal element is usually connected to the braid contact by means of an insulative spacer. Another method of terminating the center conductor of coaxial cable is to use the unsupported center conductor. The last mentioned method is relatively unreliable and fragile. The use of tubular elements crimped around the center conductor provides a excellent termination for the center conductor but is relatively expensive.

BRIEF DESCRIPTION OF THE INVENTION

A primary object of the invention is to provide an inexpensive and reliable male connector terminating means for a coaxial cable in which the center conductor is bent around and positioned within grooves formed on an extension of the insulative spacer of the connector in lieu of a tubular metal center contact.

A second purpose of the invention is an inexpensive connector for terminating a coaxial cable employing an extension of the connector dielectric which supports the extended center conductor of the cable by means of grooves formed in the dielectric extension.

A third aim of the invention is the improvement of connector terminations for coaxial cables generally.

In accordance with a preferred embodiment of the invention the circularly-shaped dielectric spacer of the connector, which ordinarily separates the braid contact from the metal tubular center conductor contact has an extension formed thereon which extends outwardly from the main body of the dielectric spacer in a direction substantially along the axis of the dielectric spacer and opposite that end of the spacer into which the cable is inserted. The center conductor of the cable extends through an aperture in the dielectric spacer and is positioned in a groove formed in the outer surface of the extension of the dielectric spacer to thereby form the center contact of the connector.

In another form of the invention the extension of the dielectric spacer has an aperture formed therethrough which extends from the aperture in the dielectric spacer through at least a portion of the spacer extension and terminates at the surface thereof. The cable center conductor extends through and out of the aperture in the spacer extension and is then positioned in a groove formed on the outer surface of said extension.

In accordance with one feature of the invention the aperture in the dielectric spacer extension can extend straight through to the end of said extension or it can exit onto the surface of the extension along the side thereof.

In accordance with another feature of the invention the grooves on the side of the extension of the dielectric spacer can be formed in many different configurations.

One such configuration is helical so that the center conductor will also have a helical configuration when it is positioned in the helical grooves on said spacer extension. The grooves have a depth less than the center conductor diameter so that said center conductor will protrude out beyond the surface of the extension to make contact with a female receptacle or jack when inserted therein.

In another configuration a groove can extend along one side of the dielectric spacer extension beginning at the point where the extension joins the dielectric spacer. The groove can then pass across the free end of the extension of the dielectric spacer and back down that side of the extension opposite the first side.

In accordance with yet another feature of the invention the grooves are arranged in such a manner that they are not presented to a receiving female jack as two grooves 180° apart but rather as two grooves less than 180° apart so that the two grooves will be positioned between individual spring-like plate elements which form the female receptacle.

BRIEF DESCRIPTION OF THE DRAWINGS

The above-mentioned and other objects and features of the invention will be more fully understood from the following detailed description when read in conjunction with the drawings in which.

DETAILED DESCRIPTION OF THE INVENTION

Figure 1:
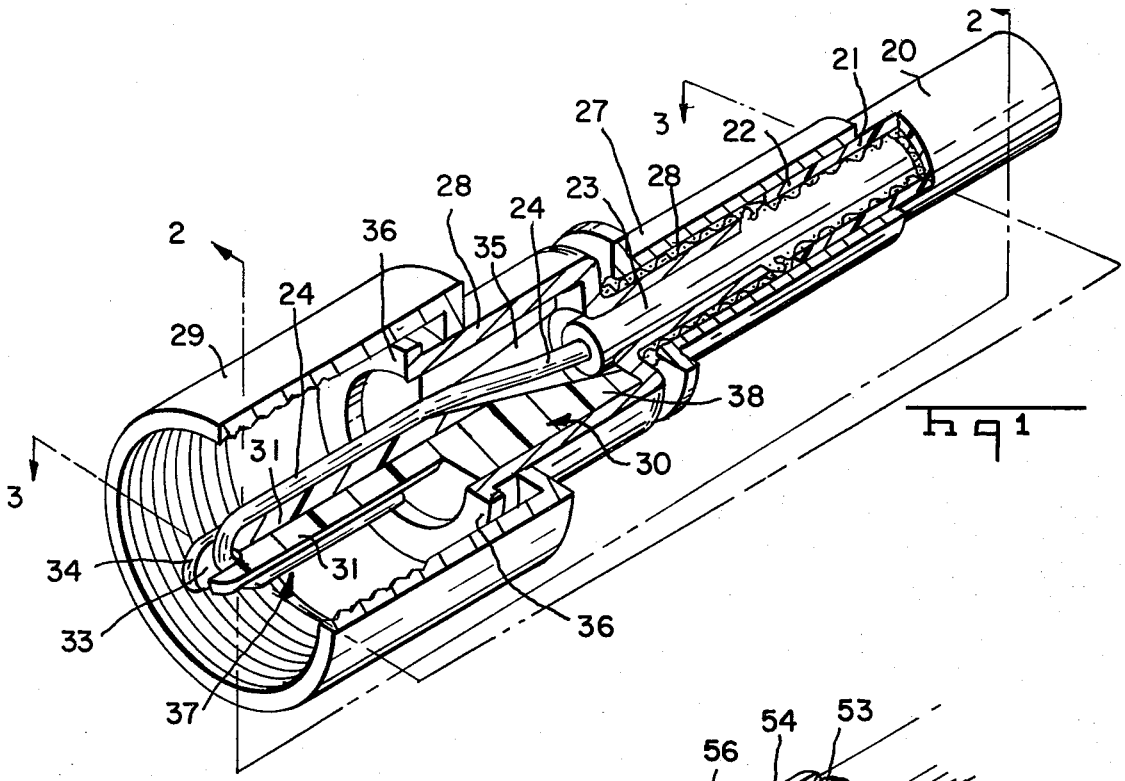
FIG. 1 is an isometric view of one form of the invention with portions broken away.

In FIG. 1*a* coaxial cable 20 is fed into a ferrule 27 of the terminating plug. The plastic sheath 21 extends about halfway into the ferrule 27 at which point it is stripped from the cable. The braid 22 extends further into the ferrule 27 and over a second ferrule 28. Cable dielectric 23 continues into the second ferrule 28 and up to the connector dielectric spacer 30 which is retained within ferrule 28 and which has an aperture 35 formed therethrough. As can be seen from FIG. 1 the said center conductor 24 extends through aperture 35 and alongside an extension 31 of the dielectric spacer 30.

Such extension 31 has a groove 33 formed therein which extends along the upper side and to the nose portion 34 and then back down the opposite side to the extension 31 towards the main body 38 of the dielectric spacer 30. It is the extension 31 of the dielectric spacer 30 with the center conductor 24 wrapped therearound which forms the center contact 37 of the coaxial connector plug.

A coupling threaded collar 29 is positioned over the flanged end 36 of ferrule 28 for securement to a mating female receptacle connector (not shown). The dimension "*d*" (FIG. 2) across the resultant center contact 37 is designed to be slightly greater than the inside diameter of the mating female connector (not shown).

Figure 2:
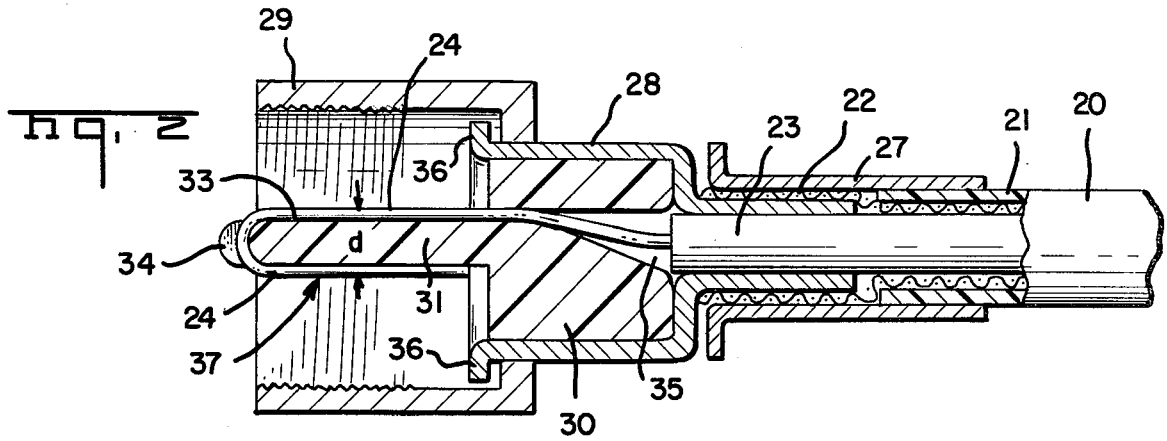
FIG. 2 is a sectional view of FIG. 1 taken along the plane 2—2.

In FIG. 2 there is shown a sectional view of the structure of FIG. 1 taken along the plane 2—2 with corresponding parts being identified by the same reference characters. The stripped center conductor 24 can be seen to extend into the aperture 35 of dielectric spacer 30 and then along the groove 33 in extension 31 to groove section 33 which extends across nose portion 34 of extension 31.

Figure 3:
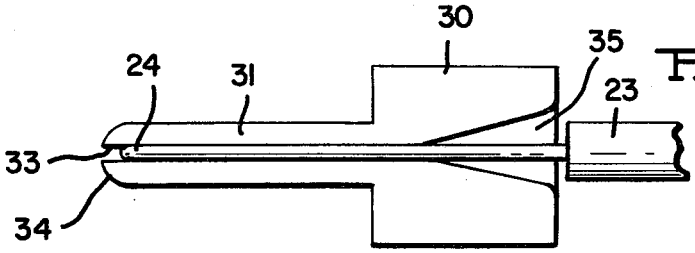
FIG. 3 is a partial sectional view of a portion of FIG. 1 taken along the plane 3—3.

In FIG. 3 the relation of center conductor 24, dielectric spacer 30 and groove 33 can be seen from a point of view 90° removed from the showing of FIG. 2.

Figure 4:
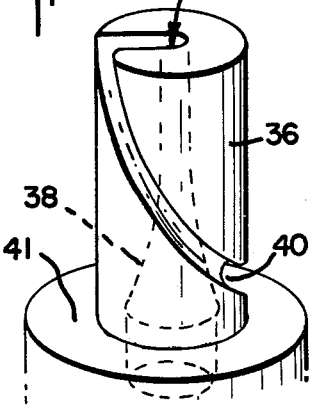
FIG. 4 shows another embodiment of the invention and specifically shows the dielectric spacer extension with grooves but without the center conductor positioned in the grooves.
Figure 5:
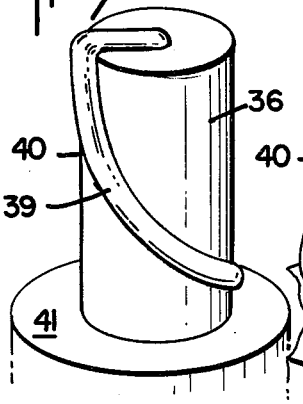
FIG. 5 is another view of FIG. 4 but with the center conductor positioned in the groove of the dielectric spacer extension.
Figure 6:
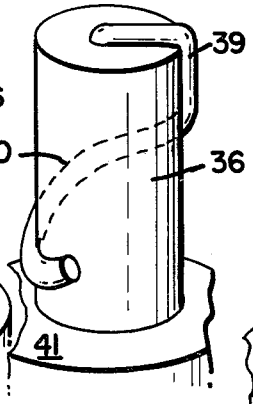
FIG. 6 is another view of FIG. 4 taken from the rear.

FIGS. 4, 5 and 6 all show a dielectric spacer extension of a particular configuration from different points of view. More specifically, FIG. 4 shows a spacer extension 36 with a groove 40 formed therein and also an aperture 38, which extends down through the center of spacer extension 36 and into an aperture extending through dielectric spacer 41, which is integrally attached to the extension 36. No conductor is shown positioned in the groove 37 of FIG. 4. However, a conductor 39 is shown in the groove 40 of the structure of FIG. 5 which, except for the said wire 39, is identical to the structure of FIG. 4. In FIG. 6 there is shown another view of the structure of FIG. 4 taken from the opposite side.

Figure 7:
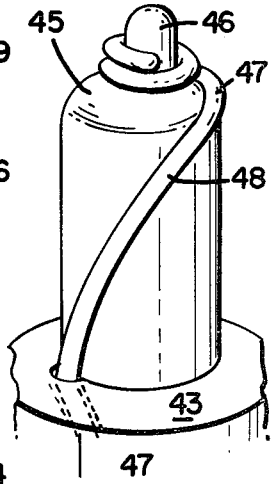
FIG. 7 shows a third embodiment of the invention in which the center conductor is terminated around a small appendix on the end of the extension of the dielectric spacer.

FIG. 7 shows another form of the invention in which the center conductor 47 of the coaxial cable is wound around the extension 45 of a dielectric spacer 43 in groove 48, which is formed in said extension 45. Such center conductor 47 is terminated at the top of extension 45 by being wound around a small secondary extension 46 formed on the end of the main extension 45. It will be observed in FIG. 7 that no aperture is formed in extension 45. However, an aperture 49 is present in the main body of the dielectric spacer 43.

Figure 8:
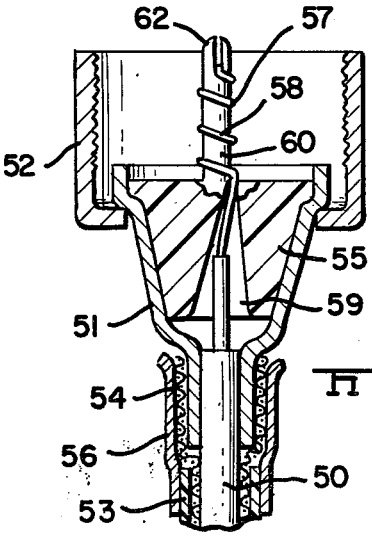
FIG. 8 shows a fourth embodiment of the invention employing a helical groove arrangement with the cable center conductor terminated in a slot formed in the end of the dielectric spacer extension.

The embodiment of FIG. 8 the center conductor 57 of the coaxial cable 50 is brought through an aperture 59 in dielectric spacer 55 and is then wound in a helical groove 58 formed in extension 60 of dielectric spacer 55. Such center conductor 57 is terminated in that portion of groove 58 which passes across nose 62 of dielectric spacer extension 60. Also shown in FIG. 8 is a ferrule 51 and a plastic coupling nut 52 for securement of the connector to a mating female connector (not shown). The braid 54 is slipped over ferrule 51 and under ferrule 56 with the outer plastic sheath 53 of cable 50 also fitting under ferrule 56.

Figure 9:
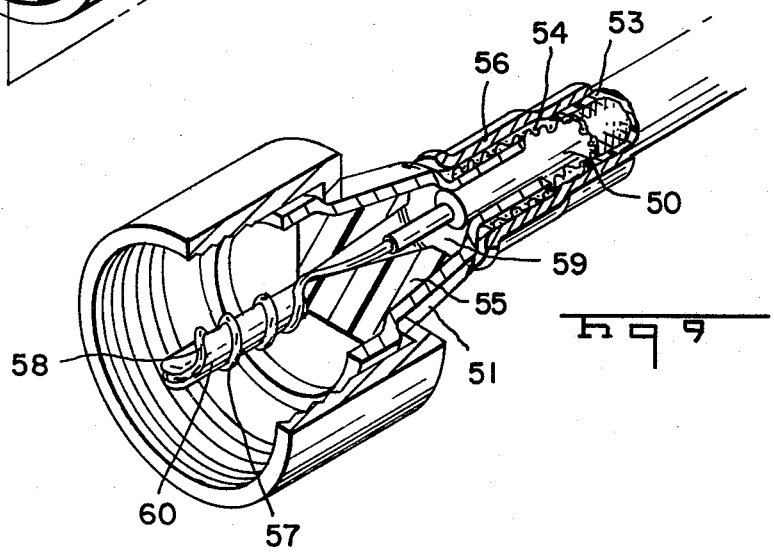
FIG. 9 is an isometric view of the structure of FIG. 8.

In FIG. 9 there is shown an isometric view of the embodiment of FIG. 9, with corresponding parts being identified by the same reference characters.

Figure 10:
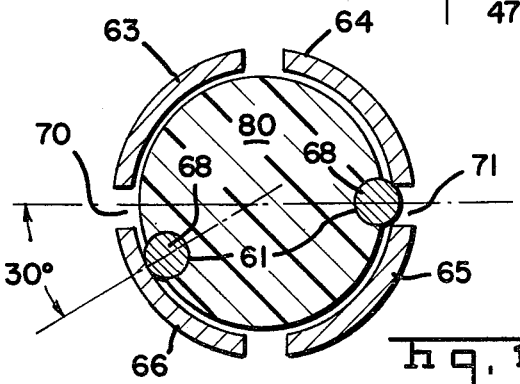
FIG. 10 is an end view of the extension of a dielectric spacer illustrating offsetting of the two grooves from opposing 180° positions.

FIG. 10 shows an end view of extension 80 of a dielectric spacer (not shown) which is similar to the dielectric spacer extensions 31 shown in FIGS. 1 and 2. The spring fingers 63, 64, 65 and 66 of a mating female center conductor are shown in FIG. 10 with gaps, such as gaps 70 and 71, positioned there-between. The grooves 61 in spacer extension 80 are formed so that they are offset from diametrically opposite positions on extension 80 to thereby prevent both portions of center conductor 62 from being positioned in one of the gaps 70 and 71. Such offsetting of center conductor 62 assures good electrical contact with the female spring contacts 63–66 regardless of the relative angular positions of extension 80 and spring members 63–66 of the mating female receptacle.

It is to be understood that the forms of the invention shown and described herein are but preferred embodiments thereof and that various changes can be made in the invention without departing from the spirit or scope thereof. For example, many different configurations of grooves can be formed around the extension of a dielectric spacer which will retain the center conductor of the coaxial cable and will provide a good mating relationship with a female receptacle.

I claim:

1. A plug termination for terminating a coaxial cable having a center conductor and an outer conductor with an insulative spacer therebetween, and with said plug comprising:

ferrule means having a first aperture extending therethrough and with a first end portion thereof inserted between said outer conductor and said insulative spacer and further with a portion of said insulative spacer having the center conductor retained therein being positioned in said first aperture at said first end of said ferrule means; and dielectric spacer means positioned within the second end of said ferrule means and comprising a main body portion having a second aperture formed therein, with the center conductor of said cable extending through said second aperture to a first end of said main body portion of said dielectric spacer means;

said dielectric spacer means further comprising a rod-like member having a free end and extending from said first end of said main body portion and further having a groove formed on the surface of said rod-like member which extends from said second aperture and contains therein a portion of said center conductor of said cable to form a center conductor contact;

the depth of at least a portion of said groove being less than the diameter of said center conductor.

2. A plug termination as in claim 1 in which said groove extends across the end of said rod-like member.

3. A plug termination as in claim 1 in which said groove is configured in a generally helical manner around said rod-like member.

4. A combination plug termination as in claim 3 in which said groove extends across the end of said rod-like member.

5. A plug termination as in claim 1 in which said groove is configured to extend from said second aperture along the side of said rod-like member, across the free end of said rod-like member and then back towards said main body of said dielectric spacer along the side of said rod-like member.

6. A plug termination as in claim 1 in which:

said second aperture extends through said rod-like member to said first end thereof; and in which said groove extends along the side of said rod-like member back towards main body of said dielectric spacer.

7. A plug termination as in claim 1 in which:

said rod-like member has a protuberance extending from said first end thereof; and in which the end of said center conductor is wound around said protuberance.

8. In combination, a coaxial cable having a center conductor, an outer conductor, and an insulative spacer between said center and outer conductors, and a plug for terminating said cable which comprises:

ferrule means having a first aperture extending therethrough;

dielectric spacer means positioned within said first aperture and having a second aperture extending therethrough;

said dielectric spacer means further comprising a rod-like member extending therefrom with grooves formed on the surface thereof;

the outer conductor of said cable being positioned over a portion of said ferrule means, the insulated center conductor being positioned within a portion of said ferrule means, and the uninsulated center conductor extending through said second aperture in said dielectric spacer means and positioned within the groove formed in the surface of said rod-like member;

the depth of at least a portion of said groove being less than the diameter of said center conductor.

9. A combination as in claim 8 in which said groove is configured around said rod-like member in a manner similar to that of a helix.

10. A combination as in claim 8 in which:

said groove extends across the end of said rod-like member.

11. A combination as in claim 10 in which said groove has a configuration around said rod-like member similar to that of a helix.

12. A combination as in claim 8 in which said groove is configured to extend from said second aperture along the side of said rod-like member.

13. A combination as in claim 8 in which:

said second aperture extends through said rod-like member to the end thereof; and in which said groove extends from the aperture at the end of said rod-like member along the side of said rod-like member back towards main body of said dielectric spacer means.

14. A combination as in claim 8 in which:

said rod-like member has a protuberance extending therefrom; and in which the end of said center conductor is wound around said protuberance.

* * * * *